US011440046B2

(12) United States Patent
Schiele

(10) Patent No.: US 11,440,046 B2
(45) Date of Patent: Sep. 13, 2022

(54) COATING EDGES USING A ROBOT

(71) Applicant: JOSEF SCHIELE OHG, Niederzissen (DE)

(72) Inventor: Stefan Schiele, Niederzissen (DE)

(73) Assignee: Josef Schiele OHG, Niederzissen (DE)

( * ) Notice: Subject to any disclaimer, the term of this patent is extended or adjusted under 35 U.S.C. 154(b) by 336 days.

(21) Appl. No.: 15/571,388

(22) PCT Filed: May 6, 2016

(86) PCT No.: PCT/EP2016/060209
§ 371 (c)(1),
(2) Date: Nov. 2, 2017

(87) PCT Pub. No.: WO2016/180731
PCT Pub. Date: Nov. 17, 2016

(65) Prior Publication Data

US 2019/0126313 A1 May 2, 2019

(30) Foreign Application Priority Data

May 8, 2015 (DE) ..... 10 2015 005 772.3

(51) Int. Cl.
*B05D 1/26* (2006.01)
*B05C 5/02* (2006.01)
*B05C 11/06* (2006.01)

(52) U.S. Cl.
CPC ..... *B05D 1/26* (2013.01); *B05C 5/0204* (2013.01); *B05C 5/0216* (2013.01); *B05C 11/06* (2013.01)

(58) Field of Classification Search
None
See application file for complete search history.

(56) References Cited

U.S. PATENT DOCUMENTS 5,336,349 A * 8/1994 Cornils ..... B05C 5/0216 156/107
5,976,249 A * 11/1999 Stahl ..... B05C 5/0254 118/326

(Continued)

FOREIGN PATENT DOCUMENTS

DE 29617525 U1 12/1996
DE 102013003688 A1 4/2014
EP 0707937 A1 4/1996

OTHER PUBLICATIONS

Robotic Application of Glass Primer by Flexible Automation, Inc., published Feb. 21, 2013, retrievable from https://www.youtube.com/watch?v=y3HUFrylcQk.*

(Continued)

*Primary Examiner* — Michael P. Rodriguez
(74) *Attorney, Agent, or Firm* — The Dobrusin Law Firm, P.C.

(57) ABSTRACT

Disclosed is an apparatus for at least partially, preferably entirely coating the peripheral edge of a workpiece, comprising a feeding device that has a coating head; a coating application means that applies the coating to the peripheral edge as well as an air flow are provided on/in the coating head, said air flow removing excess coating from the edge; the workpiece and the coating head are moved relative to one another. The invention further relates to a method for coating the peripheral edge of a workpiece with the aid of a coating head.

18 Claims, 4 Drawing Sheets

(56) References Cited

U.S. PATENT DOCUMENTS

Figure 1:
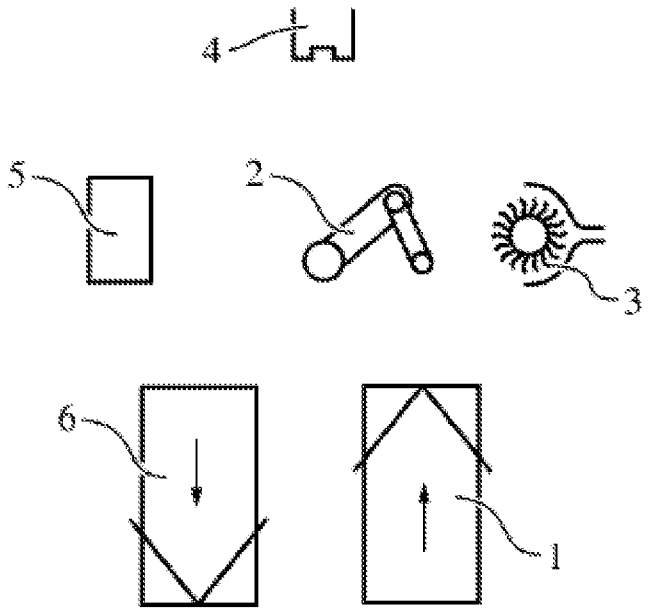

| | | | | |
|---|---|---|---|---|
| 2005/0129856 | A1* | 6/2005 | Delle Vedove | B05B 16/00 427/356 |
| 2011/0059257 | A1* | 3/2011 | Shibata | B05C 5/001 427/425 |
| 2015/0069149 | A1* | 3/2015 | Nalin | B05B 1/14 239/548 |
| 2016/0052012 | A1 | 2/2016 | Mohr | |

OTHER PUBLICATIONS

International Preliminary Report on Patentability for International Application No. PCT/EP2016/060209, dated Mar. 30, 2017.
International Search Report for International Application No. PCT/EP2016/060209, dated Jul. 26, 2016.

* cited by examiner

COATING EDGES USING A ROBOT

An apparatus for at least partially, preferably fully, coating the peripheral edge of a workpiece, having a coating apparatus which has a coating head, wherein the coating head has provided on/in it a coating-application means, which applies the coating to the peripheral edge, and an air stream, which removes excess coating from the edge, wherein the workpiece and the coating head are moved relative to one another. The present invention also relates to a method of coating the peripheral edge of a workpiece using a coating head.

Such apparatuses and methods are known from the prior art and are used, for example, for coating the edges of parquet or window profiles. The workpiece here is positioned on a conveyor belt and guided along a coating head, which applies the coating, for example a lacquer or an adhesive, to the edge. These apparatuses, however, are not suitable for complex components.

It has therefore been the object of the present invention to provide an apparatus and a method which do not have the disadvantages of the prior art.

The object is achieved by an apparatus for at least partially, preferably fully, coating the peripheral edge of a workpiece, having a coating apparatus which has a coating head, wherein the coating head has provided on/in it a coating-application means, which applies the coating to the peripheral edge, and an air stream, which removes excess coating from the edge, wherein the workpiece and the coating head are moved relative to one another, wherein the movement is provided for by a movement means and takes place in at least two directions in space.

The statements made in relation to this subject matter of the present invention apply equally to the method according to the invention, and vice versa.

The present invention relates to a coating apparatus which applies, for example, a lacquer, in particular a water-based lacquer, and/or an adhesive and/or a plastics material, for example a seal, to at least part of the peripheral edge of a workpiece. The workpiece may be produced from wood, metal, plastics material or a combination thereof. The workpiece may be, for example, rectangular, square, round, elliptical or of any other desired shape. In particular, the workpiece is of panel-like configuration, i.e. one dimension is significantly smaller than the other two. It is always the case that at least part of the peripheral edge, preferably the entire peripheral edge, is provided with a coating agent, wherein it may be important for the coating to be provided uniformly, in particular for no build-ups of lacquer to be present.

The coating apparatus has, according to the invention, a coating head or the application chamber by way of which the lacquer is applied, wherein the application head and the workpiece move relative to one another during the coating operation. It is preferably the case that the coating head or the application chamber is fixed in location and the workpiece moves relative to the coating head. It is also the case according to the invention that the layer thickness by which the lacquer is applied to the workpiece is regulated by an air stream, which removes excess lacquer from the workpiece again and/or distributes it uniformly over the workpiece. This air stream is generated preferably in that the coating head or the application chamber has applied to it a negative pressure, by which air is taken in through a gap between the workpiece and the coating head or the application chamber and strips off excess lacquer from the workpiece.

It is preferably the case that, downstream of the coating head or the application chamber, said air stream is fed to a separating-off system, which removes the constituents of lacquer at least in part, preferably more or less in full, from the air stream.

According to the invention, the apparatus, then, has a movement means which moves the workpiece or the coating apparatus in at least two directions in space. This makes it possible even for the edges of complex components and/or for the entire peripheral edge of a workpiece to be coated.

The movement means is preferably an industrial robot. An industrial robot is a preferably universal, programmable machine. The machine generally comprises a manipulator, also referred to as a robot arm, a control means and an effector, in this case a gripper, which grips the workpiece and/or can be connected to the coating apparatus. The effector is preferably a suction means, to which the workpiece can be connected in a reversible manner. The industrial robot is preferably equipped with one or more sensors in order to sense, for example, the contour of the workpiece. Once programmed, the machine is capable of executing an operating sequence autonomously or of varying the execution of the task, within limits, in dependence on sensor information.

The industrial-robot arm preferably has at least two levers, which can be moved by an articulation relative to one another. It is preferably possible for the two levers to alter their angle in relation to one another and/or to rotate relative to one another. The robot arm is preferably provided such that it can be rotated as a whole relative to its bearing. The effector is preferably provided in a movable manner at the one end of a lever. It is preferably the case that at least one lever is, and preferably both levers are, provided in a rotatable manner about its/their longitudinal axis.

The effector causes the workpiece or a treatment means, for example the coating apparatus, to be fastened in a reversible manner on the robot arm. The effector is preferably a suction gripper.

The workpiece preferably moves in a plane which is oriented in particular horizontally. If required, the workpiece can move in a plurality of planes, for example so that treatment regions can overlap without any risk of collision.

The movement means preferably moves the workpiece and/or the coating head, or some other treatment tool or drying tool, in at least two directions in space which are provided at an angle in relation to one another. As a result, in particular the peripheral edge of the workpiece and the corresponding tool are moved relative to one another.

The movement means preferably rotates the workpiece, in particular about a horizontal axis of rotation, wherein the workpiece itself need not, although it may well, be rotationally-symmetrical.

According to the invention, the coating means has a means for generating an air stream. The latter means is, in particular, a negative pressure in the coating chamber or in the coating head. As a result, between the coating means and the workpiece, air is taken into the coating chamber and passes along the workpiece and thus removes excess coating material from the workpiece and/or distributes it, i.e. smooths it, over the tool.

The coating means, in particular the coating chamber, also has one or more, in particular four, means, for example nozzles, for applying the coating agent to the edge of the workpiece. The air stream and/or the application means can preferably be controlled and/or regulated, in particular switched on and off, separately from one another. Particularly preferably, it is possible to maintain the air stream without any coating agent exiting from the application means.

It is preferably the case that the movement means, in particular the industrial robot, orients the workpiece prior to the latter being treated. This can be done by measurement and/or by means of a defined stop. As a result of the orientation, the industrial robot knows the position of the workpiece relative to the robot arm and can regulate the movement of said workpiece accordingly.

The apparatus according to the invention preferably has an open-loop/closed-loop controller, which controls/regulates the individual stations of the apparatus. The open-loop/closed-loop controller preferably has a means which senses the position of the workpiece in space and/or the movement thereof. The stations are controlled/regulated in dependence thereon. For example, the coating nozzles are switched off just before, after or during a 360° rotation of the workpiece and/or the axis of rotation of the workpiece is displaced as soon as, or once, the workpiece has rotated through 360°.

The movement speed of the workpiece can alter or remain the same while the workpiece is being treated.

Another subject matter of the present invention is constituted by a method of coating the peripheral edge of a workpiece using a coating head, in the case of which at least one portion of the peripheral edge passes the coating head at least twice.

The invention provides for the peripheral edge of a workpiece to be coated. For example, the workpiece is rotated in the process. In order to ensure that the coating has been achieved throughout, i.e. along the entire peripheral edge, it is usually the case that a narrow region is subjected to double lacquering. This double lacquering is removed, and/or distributed over the adjacent parts of the peripheral edge, during the second passage operation.

It is preferably the case that the process conditions which prevail on/in the coating head during the first passage operation are different, at least at certain points in time, from those which prevail during the second passage operation. For example, coating agent is applied during the first passage operation and not during the second passage operation. For this purpose, the air stream is activated during the second lacquering operation. As a result, during the second passage operation, possibly double-application coating agent is distributed and/or removed so as to avoid the creation of build-ups or runs.

It is preferably the case, during the first passage operation, that a coating agent is applied to the workpiece and, if appropriate, excess coating agent is removed by means of an air stream.

It is preferably the case that, during the second passage operation, coating agent is removed and/or distributed in particular by the air stream. During the second passage operation, there is preferably no coating agent flowing out of the coating nozzles of the coating head.

It is preferably the case that the relative movement between the workpiece and coating head during the first passage operation is different from that during the second passage operation. For example the workpiece performs a circular movement during the first passage operation and a spiral movement during the second passage operation, i.e. the position of the axis of rotation alters. It is preferably the case that the distance between the axis of rotation and coating agent increases during the second passage operation of the respective portion of the peripheral edge.

Figure 2:
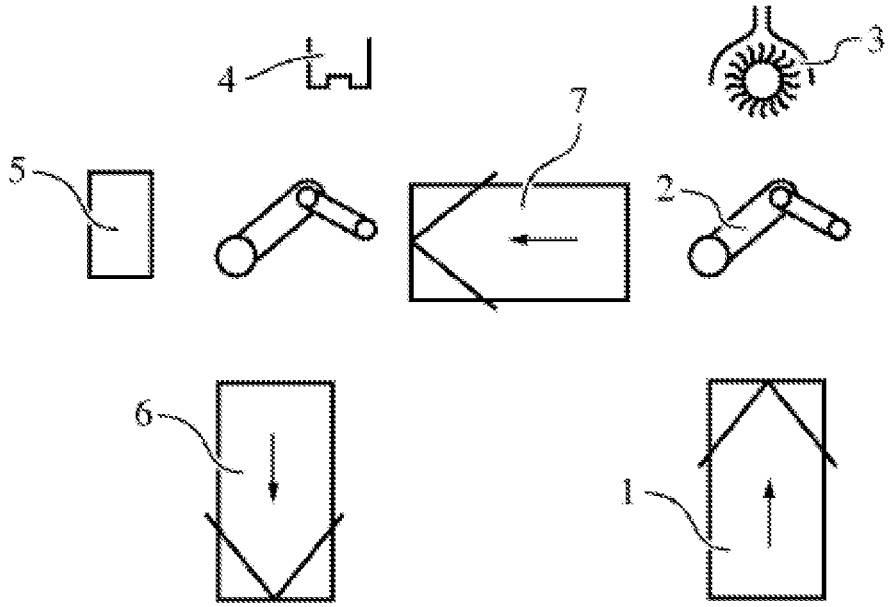
Figure 3:
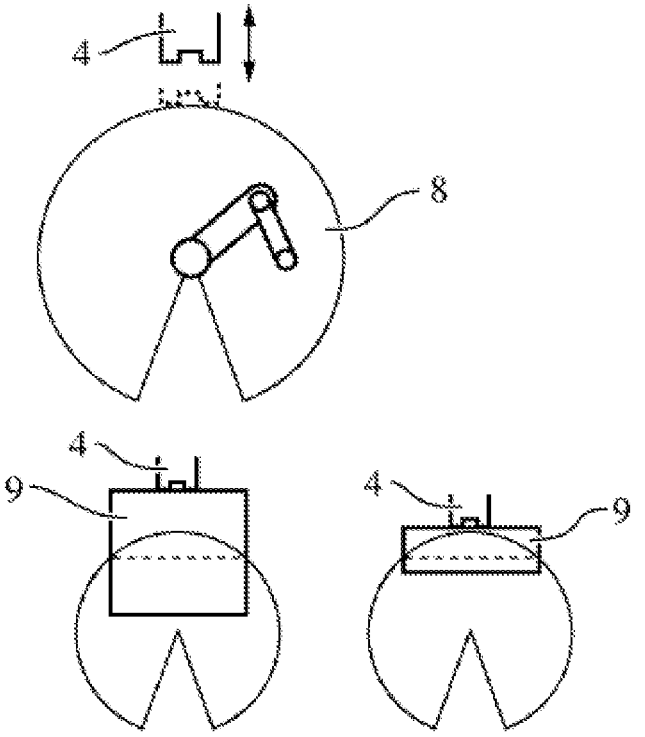
Figure 4:
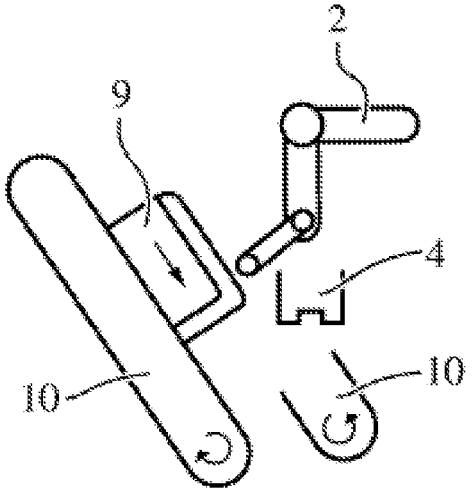
Figure 5:
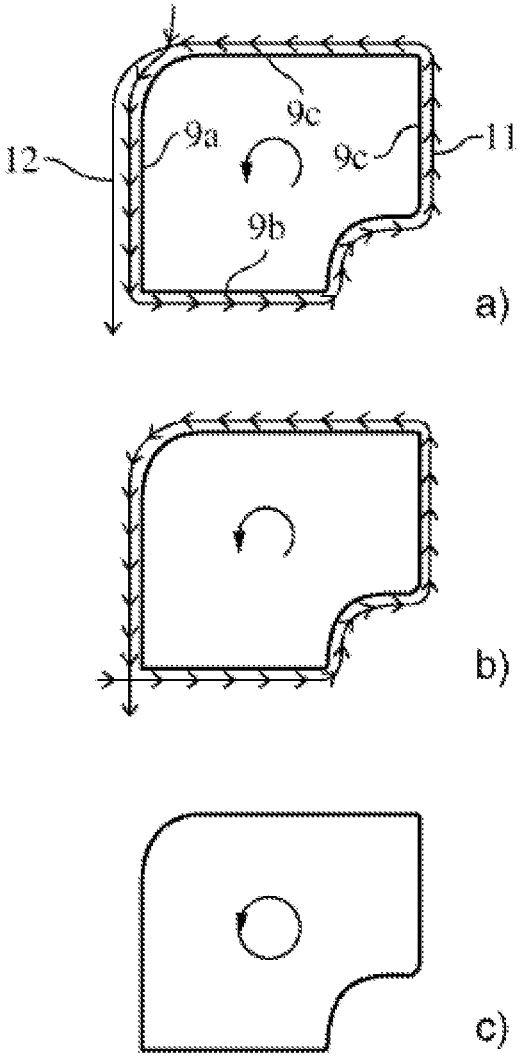

The inventions will be explained hereinbelow with reference to the figures. These explanations are given merely by way of example and do not limit the general concept of the invention. In the figures:

FIG. 1 shows a first embodiment of the apparatus according to the invention, FIG. 2 shows a further embodiment of the apparatus according to the invention, FIG. 3 shows an embodiment in which the coating apparatus is provided such that it can be moved relative to the industrial robot, FIG. 4 shows an embodiment in which the coating apparatus is arranged on the industrial robot, and FIG. 5 shows an embodiment of the method according to the invention.

FIG. 1 shows a first embodiment of the method according to the invention. The workpiece, which may be, for example, round or rectangular or of any desired shape and which may consist, for example, of metal, wood, plastics material or a combination thereof, is moved into the operating region of the movement means 2, in the present case designed in the form of an industrial robot, via an entry conveyor 1, for example an endless belt or a clamping apparatus, for example a chuck which is moved via a displacement apparatus. The arm of the industrial robot 2, in this example, is equipped with a first and a second lever, wherein the second lever is provided at the end of the first lever. It is possible to alter the angle of the two levers in relation to one another. Moreover, it is also possible to alter the angle of the first lever relative to the fastening of the industrial robot. The industrial robot is provided for movement as a whole about a vertically rotatable axis. It is preferably possible, in addition, for at least one of the levers, preferably both levers, to rotate about a longitudinal axis. Provided at the end of the second lever, in particular in an articulated manner, is a gripper, which is designed preferably in the form of a suction gripper which sucks firmly to the workpiece in order for the latter to be capable of being raised and moved without any alteration in the position of the workpiece relative to the gripper. The industrial robot grips the workpiece and orients it. As an alternative, the workpiece is already oriented when positioned at the end of the entry conveyor. The orientation by means of the industrial robot takes place either via measurement of the workpiece, for example above the entry conveyor, and/or by displacement of the workpiece, for example, by means of the industrial robot, against a defined stop, for example of the entry conveyor. Once the industrial robot has gripped the workpiece, it transports it for example to a coating-preparation station, for example a grinding station 3. A person skilled in the art will be aware that this coating-preparation station, nevertheless, need be present only as an option. The edge of the workpiece is then coated in a coating apparatus 4. This coating apparatus has a coating head, in which are present one or more coating nozzles which apply a coating agent, for example a lacquer, to the edge of the workpiece. The coating head preferably contains an air stream which is generated in particular by a negative pressure, which is present on the coating head, in order for excess coating material to be removed from the edge of the workpiece and/or for the coating agent to be distributed over the peripheral edge. During the coating operation, preferably the workpiece moves relative to the coating head, which is in a fixed location during the coating operation. It is preferably the case that the entire peripheral edge of the workpiece is coated. For this purpose, the industrial robot rotates the workpiece preferably about a vertical axis of rotation during the coating operation. As an alternative, or in addition, it is also possible, however, for the coating apparatus to be moved relative to the workpiece. Once the peripheral edge has been provided, at least in part, with a coating agent, the industrial robot transports the workpiece to a drying unit 5. It is also the case during the drying operation that the industrial robot moves the workpiece in particular relative to the preferably fixed-location drying unit. As an alternative, or in addition, it is also possible, however, for the drying unit to be moved relative to the workpiece. Depending on the surface-related requirements, the treatment can be repeated. Once the coating has been dried, at least in part, the workpiece is optionally transported, once again by the industrial robot, to an exit conveyor 6, which moves the workpiece out of the operating region of the robot.

It is possible for the treatment stations either to face away from the robot or to be arranged around the foot of the robot.

The coating head is preferably of comparatively narrow design. In particular, its extent parallel to the movement direction of the workpiece is less than 20 mm. The coating agent is preferably injected into the coating head from 3 or 4 sides, wherein in each case two nozzles are provided preferably at an angle of 45°-180° in relation to one another.

The dryer may be, for example, a UV dryer or an IR dryer. However, it is possible to provide for a plurality of dryers, which can be activated independently of one another. The UV lamps are, for example, gallium and/or mercury UV lamps.

A person skilled in the art will be aware that a workpiece can enter a treatment station a number of times. For example, an operating sequence may be as follows:

The workpiece is placed in position
The workpiece is conveyed into the operating region of the industrial robot
The workpiece is accommodated and/or oriented by the industrial robot
At least one edge, preferably the entire peripheral edge, of the workpiece is ground
At least one, preferably the entire, peripheral edge of the workpiece is lacquered
The coated edges are dried
The workpiece is set down on the exit conveyor
The tool is conveyed out.

An operating sequence in which the edges are lacquered twice may be, for example, as follows:

The workpiece is placed in position
The workpiece is conveyed into the operating region of the industrial robot
The workpiece is accommodated and oriented, for example by the industrial robot
At least one edge, preferably the entire peripheral edge, is ground
At least one sub-region, preferably the entire peripheral edge, is lacquered
The coated regions are dried
At least one sub-region, preferably the entire of the peripheral edge, is ground
At least one sub-region, preferably the entire peripheral edge, is lacquered
The newly coated region of the peripheral edge is dried
The workpiece is set down on the exit conveyor
The workpiece is conveyed out.

FIG. 2 shows a further embodiment of the apparatus according to the invention. In comparison with the embodiment according to FIG. 2, the present embodiment provides two industrial robots 2, which may be of identical or different design. A set-down and/or transporting means 7 is preferably located between the two industrial robots. In the case of the present embodiment, the cycle time for treating a workpiece may be divided up between 2 industrial robots. For example, the first industrial robot transports the workpiece during the preparatory step, in this case the grinding operation. The second industrial robot moves the workpiece as it is being coated and/or dried. It is possible to provide, between the two industrial robots, an additional set-down or transporting means 7, on which the workpieces are set down after being coated, and/or prior to being coated, and/or on which the workpieces are set down and/or transported after being coated, so that they can be fed anew to lacquering preparation. A person skilled in the art will be aware that it is also possible for more than two industrial robots to be present.

FIG. 3 shows a further embodiment of the apparatus according to the invention. In the present case, for example the coating apparatus, the coating-preparation unit 3 and/or the drying unit are/is provided for movement relative to the operating region 8 of the robot. These stations are moved prior to and/or during the respective treatment operation. The movement of one or more of the stations 3-5 has, in particular, the advantage that workpieces of different sizes can be adapted to the operating region of the industrial robot.

FIG. 4 shows an embodiment of the apparatus according to the invention in which the coating head 4 is provided on the arm of the industrial robot. A person skilled in the art will be aware that it is also possible for the coating-preparation unit 3 and/or the drying unit 5 to be provided on the robot arm. In the present case, the workpiece 9 is fixed in location and/or is moved by a transporting means 10, in this case 2 conveyor belts, during the coating operation. It is also possible, however, for the transporting means 10 just to serve for transporting the workpiece 9 into the operating region of the industrial robot.

FIG. 5 shows the operations of lacquering, grinding and drying a workpiece. FIG. 5*a* illustrates the operation of lacquering the workpiece. It is clearly evident that first of all the peripheral edge 9*a*, then the peripheral edge 9*b*, thereafter the peripheral edge 9*c* and finally the peripheral edge 9*d* are lacquered. The pump, which supplies the nozzles with coating agent, is activated during this lacquering operation. As illustrated by the arrow, the workpiece is rotated in the counterclockwise direction during the lacquering operation. As an alternative, or in addition, it is also possible for the workpiece to be at a standstill and for the coating head to move. Before, as soon as and/or after the point of the peripheral edge where lacquering started is located once again in the coating head, the lacquering nozzles are deactivated, but the workpiece continues to be transported, as indicated by the arrow 12, along the coating head. As a result, in particular coating material in the form of a double coating is removed and/or distributed over the adjacent regions so as to avoid the formation of any build-ups of lacquer. This is achieved by the air stream in the coating head, said air stream being produced preferably by the negative pressure applied.

For the case where the component is a round one, the workpiece, following a 360° rotation, is rotated further in the same direction and, in the process, drawn slowly out of the coating head. The workpiece thus performs, in part, a spiral movement. The distance between the axis of rotation of the workpiece and the coating head increases. The air stream in the coating head here remains active and preferably increases. As a result, coating material in the region where double lacquering has taken place is distributed, in particular, over the adjacent region and therefore this region where double lacquering has taken place is smoothed.

As can be gathered from FIG. 5*b*, during the grinding operation, the workpiece is likewise rotated about an axis of rotation, which is illustrated by the arrow. The peripheral edge is ground throughout the rotation. As soon as the region of the peripheral edge has been ground in its entirety, the industrial robot removes the workpiece from the grinding means.

The same applies to the drying operation (FIG. 5*c*). Here too, as illustrated by the arrow, the workpiece is rotated relative to a dryer. The coating material applied to the peripheral edge dries.

LIST OF REFERENCE SIGNS

1 entry conveyor
2 movement means, industrial robot
3 pre-treatment means, grinding means, grinding brush
4 coating apparatus, application chamber
5 dryer, UV dryer, IR dryer
6 exit conveyor
7 set-down and/or transporting means
8 operating region of the movement means 2
9 workpiece
9*a-d* edge portion, peripheral-edge portions of the workpiece
10 conveying means
11 coating phase
12 smoothing phase

The invention claimed is:

1. A method of coating a peripheral edge of a workpiece using a coating apparatus having a coating head, comprising applying a coating agent to the peripheral edge via a coating-application means provided on/in the coating head;
wherein at least one portion of the peripheral edge passes the coating head at least twice;
wherein, during a first passage operation, a coating agent is applied to the workpiece and excess coating agent is removed by means of an air stream;
wherein the coating head has a means for generating the air stream, and wherein the means is a negative pressure;
wherein, during a second passage operation, the coating agent is removed and/or distributed and the coating agent is not applied to the workpiece;
wherein the coating apparatus has a movement means which is configured such that the workpiece and the coating head are moved relative to one another;
wherein movement takes place in at least two directions in space; and
wherein the coating-application means and the means for generating the air stream can be operated separately from one another.

2. The method as claimed in claim 1, wherein process conditions which prevail in the coating head during the first passage operation are different from those which prevail during the second passage operation.

3. The method as claimed in claim 1, wherein relative movement between the workpiece and coating head during the first passage operation differs from that during the second passage operation.

4. The method as claimed in claim 1, wherein the movement means moves the workpiece and/or the coating head in at least two directions in space which are provided at an angle in relation to one another.

5. The method as claimed in claim 1, wherein the movement means rotates the workpiece.

6. The method as claimed in claim 1, wherein the movement means orients the workpiece prior to the latter being treated.

7. The method as claimed in claim 2, wherein relative movement between the workpiece and coating head during the first passage operation differs from that during the second passage operation.

8. The method as claimed in claim 2, wherein the movement means moves the workpiece and/or the coating head in at least two directions in space which are provided at an angle in relation to one another.

9. The method as claimed in claim 3, wherein the movement means moves the workpiece and/or the coating head in at least two directions in space which are provided at an angle in relation to one another.

10. The method as claimed in claim 2, wherein the movement means rotates the workpiece.

11. The method as claimed in claim 3, wherein the movement means rotates the workpiece.

12. The method as claimed in claim 4, wherein the movement means rotates the workpiece.

13. The method as claimed in claim 2, wherein the movement means orients the workpiece prior to the latter being treated.

14. The method as claimed in claim 3, wherein the movement means orients the workpiece prior to the latter being treated.

15. The method as claimed in claim 4, wherein the movement means orients the workpiece prior to the latter being treated.

16. The method as claimed in claim 5, wherein the movement means orients the workpiece prior to the latter being treated.

17. The method as claimed in claim 12, wherein the movement means orients the workpiece prior to the latter being treated.

18. The method as claimed in claim 1, wherein the apparatus fully coats the peripheral edge of the workpiece.

* * * * *